United States Patent [19]

Ericsson

[11] 3,948,170

[45] Apr. 6, 1976

[54] ARRANGEMENT IN SILKSCREEN PRINTING MACHINE

[76] Inventor: Sylve Jack Donald Ericsson, Branta Backen 17 IV, 147 00 Tumba, Sweden

[22] Filed: Apr. 19, 1973

[21] Appl. No.: 352,543

[30] Foreign Application Priority Data

May 25, 1972 Sweden ..... 6856/72
Jan. 30, 1973 Sweden ..... 73012833

[52] U.S. Cl. ..... 101/124; 101/126; 101/232; 271/261; 271/277

[51] Int. Cl.[2] ..... B41F 15/38; B65H 7/08

[58] Field of Search ..... 101/114, 126, 116, 232, 101/118, 407 R, 407 A, 129, 124; 271/53, 57, 53 MG, 277, 261

[56] References Cited

UNITED STATES PATENTS

| | | | |
|---|---|---|---|
| 2,551,364 | 5/1951 | Coakley | 271/57 |
| 2,818,252 | 12/1957 | Nilsson | 271/57 |
| 2,977,115 | 3/1961 | Vandeman | 271/53 |
| 3,120,180 | 2/1964 | Black et al. | 101/124 |
| 3,163,106 | 12/1964 | Failor | 101/DIG. 3 |
| 3,240,487 | 3/1966 | Templeton | 271/53 |
| 3,241,831 | 3/1966 | Axlid | 271/53 |
| 3,254,888 | 6/1966 | Street | 271/57 |
| 3,310,304 | 3/1967 | Foias et al. | 101/232 UX |
| 3,647,205 | 3/1972 | Schone et al. | 271/53 X |

FOREIGN PATENTS OR APPLICATIONS

| | | | |
|---|---|---|---|
| 431,633 | 7/1935 | United Kingdom | 101/232 |

*Primary Examiner*—Edgar S. Burr
*Assistant Examiner*—R. E. Suter
*Attorney, Agent, or Firm*—Eric Y. Munson

[57] ABSTRACT

A silkscreen printing machine, having a printing drum supporting material which is to be printed. Sensing means for indicating the position of the material are arranged on the drum, and an adjusting device is arranged to stop the front edge of the material at a predetermined position, in which gripper means grips the material.

5 Claims, 5 Drawing Figures

ARRANGEMENT IN SILKSCREEN PRINTING MACHINE

BACKGROUND OF THE INVENTION

The present invention relates to an arrangement in a silkscreen printing machine, and more particularly to an arrangement which indicates when the position of the material to be printed on the machine deviates from the intended position. The invention is intended for use with the type of silkscreen printing machine in which a printing drum is arranged to carry material which is to be printed. Cooperating with the drum is a stencil, which, during a printing operation, is pressed against the material by means of a so-called spueegee. As previously mentioned, the arrangement according to the invention is intended to indicate when the position of the aforesaid material during an actual printing operation deviates from a determined position. Thus, the arrangement shall be capable of indicating when the position assumed by the material in the gripping elements of the machine deviates from an exact predetermined position.

It has been found that particularly high requirements must be imparted to a printing drum used in a silkscreen printing machine of the above-mentioned type, where the printing drum is arranged for reciprocating or translatory movement. Such machines are also provided with a reciprocating movable frame in which the stencil is firmly secured, the movement of which frame is controlled by the movement of the drum. When the operating speed of such a silkscreen printing machine is increased, it is obvious that this increase in speed also produces an increase in kinetic energy. It has been found in practice that the increased kinetic energy imparted to the printing drum, the frame and other machine components, creates complicated problems. One such problem resides in the fact that the drum is unable to stop in exactly the same position each time to grip the material to be printed. This applies to a low kinetic energy level as well as to a high kinetic energy level. For example, at excessively high kinetic energy levels, the drum will over-rotate. One common answer to this problem is to lessen the weight of all of the machine elements. Although this solution might reduce the problem somewhat, it would not solve it completely.

The present invention contemplates a silkscreen printing machine having a reciprocating or translatory drum comprising means for indicating the position of the sheet material on the drum, thereby ensuring that the sheet is located in an exact predetermined position during a printing sequence.

The problem is not satisfactorily solved, however, merely by providing means in a silkscreen printing machine of the above type for indicating a deviated or displaced position of the sheet material which is held by the gripping elements. The indicating means must also be positioned in conjunction with gripping elements mounted on the drum, so as to permit the position of the sheet material in the gripping elements to be indicated. A fully satisfactory solution is achieved by having the leading edge of the sheet material engage a stop, so as to ensure that the leading edge assumes the exact position for engagement with the gripping elements. Furthermore, the stop should be designed to move away from the position in which it contacts the sheet material, immediately upon or after engagement of the gripping elements with the leading edge of the sheet material.

As previously mentioned, an increase in the speed of a silkscreen printing machine of the above type results in an increase in kinetic energy, which in turn causes the drum to stop not exactly in the same place each time to engage the sheet material to be printed. This holds true for low kinetic energy levels as well as for high kinetic energy levels, and at high speeds the drum will over-rotate. In order to position the leading edge of the material exactly in relation to the gripping elements, irrespective of the drum speed, the stop is mounted for movement to permit alignment of the leading edge with the position of the gripping elements.

SUMMARY OF THE INVENTION

Accordingly, the present invention relates to an arrangement in silkscreen printing machines having a reciprocating or translatory movable printing drum and a stencil cooperating therewith, said stencil during a printing sequence being urged against a length of sheet material to be printed by means of a squeegee. The invention furthermore includes means for producing an indicating signal when the sheet material, held by gripping elements, assumes a position deviating from a predetermined position. The indicating signal is produced by means of beam transmitters placed in the immediate vicinity of beam receivers, said transmitters and receivers being at least two in number and being located adjacent the leading edge of the sheet material. The respective beam transmitters are connected to an indicating means and arranged to activate said means when the position of said sheet material deviates from a predetermined position. The arrangement is mainly characterized by the fact that the beam transmitters and the beam receivers are firmly mounted on the drum adjacent the gripping elements arranged thereon, to detect and indicate the position of the sheet material in the gripping elements.

DESCRIPTION OF A PREFERRED EMBODIMENT

Figure 1:
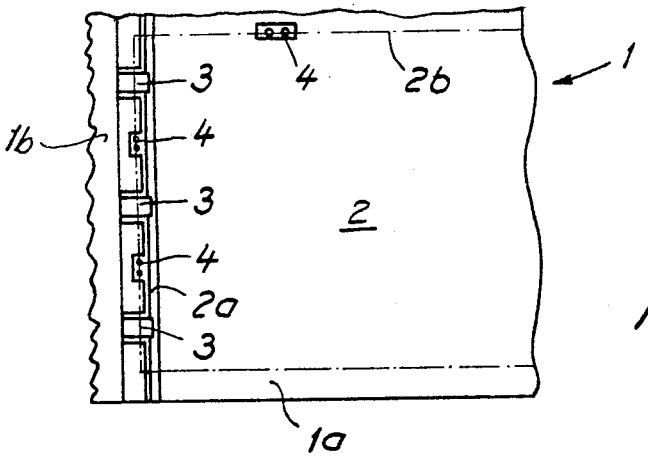
FIG. 1 shows in plan view a silkscreen printing machine havng a reciprocating or translatory movable drum with portions cut away in order to simplify the view.

Referring to the accompanying drawing, FIG. 1 illustrates an arrangement according to the invention mounted on a silkscreen printing machine 1, comprising a feed table 1*a* and a reciprocating or translatory movable drum 1*b*. Cooperating with the drum 1*b* is a stencil (not shown in the figure) which during a printing sequence is pressed by means of a squeegee against the peripheral surface of the drum and against the sheet material 2 to be printed after it has been moved beneath the squeegee by the gripping elements mounted on the drum. The arrangement according to the invention is designed to indicate when the sheet material 2 assumes a position which deviates from a predetermined position. The sheet material 2 is moved to the feed table 1*a* so that the leading edge of the material assumes a desired position, this position being such that it can be accurately retained by the gripping elements 3 on the printing drum 1*b*. The construction of the elements 3 in relation to the drum is irrelevant to an understanding of the arrangement of the present invention and will not therefore be described. A plurality of beam receiving and beam transmitting devices 4 are mounted adjacent gripping elements 3. As will be seen from FIG. 1, two of the beam transmitting and receiving devices are placed adjacent the leading edge 2*a* of the sheet material and serve to indicate that the sheet material is exactly aligned in the gripping elements. A beam transmitting device and a beam receiving device are also placed adjacent respective side edges 2*b* of the sheet material.

According to the invention, each beam transmitter and beam receiver is conveniently placed in the immediate vicinity of the other. Since each transmitter and receiver has its own detecting circuit, only one such transmitter and receiver will be described with reference to the circuit diagram illustrated in FIG. 2. It will be understood, however, that exactly the same coupling technique can be applied to the construction of the other beam transmitters and beam receivers incorporated in the system. The beam transmitting device is suitably constructed to produce a beam of light within the infra-red-range.

Figure 2:
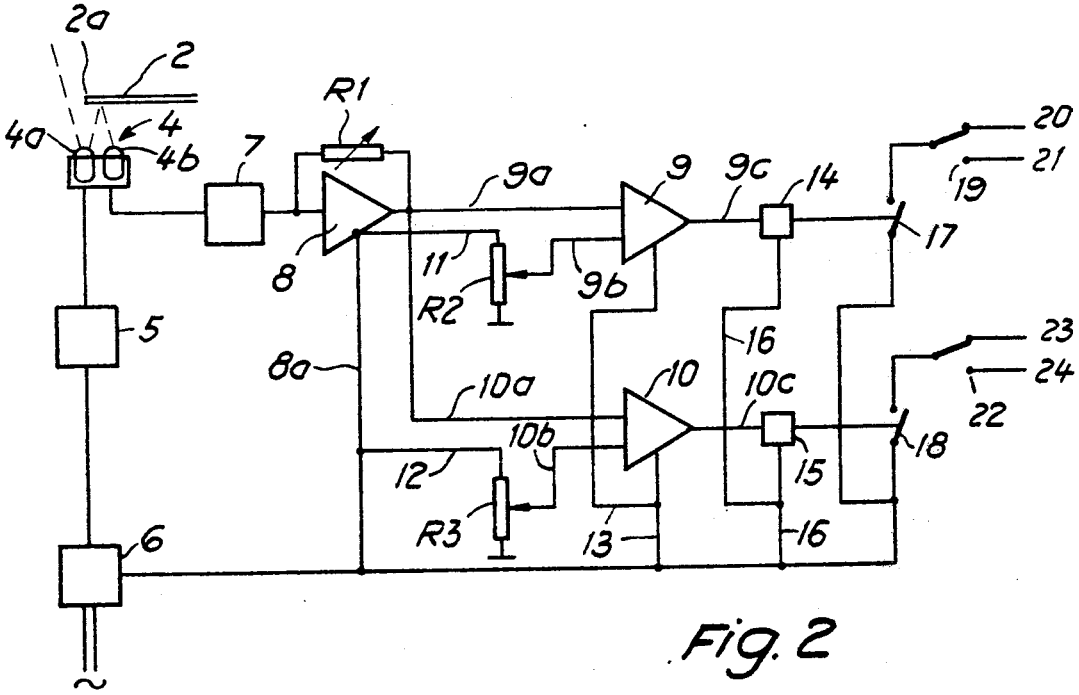
FIG. 2 is an electric circuit diagram for the means indicating the position assumed by the sheet material when it deviates from a predetermined position; it also shows a beam transmitter and a beam receiver.

FIG. 2 shows a beam transmitter and a beam receiver placed in a common housing generally indicated by the arrow 4. The beam transmitter is indicated by the reference numeral 4*a*, while the beam receiver is indicated by the reference numeral 4*b*. The beam transmitter 4*a* is fed by a modulator 5, which can be adjusted to a frequency of 5kHz. The modulator in turn is driven by a source of rectifying current 6, which source may comprise any appropriate type of a.c/d.c. converter.

The beam receiver 4*b* is connected to a filter 7 designed to allow frequencies over 1 kHz. to pass therethrough. Thus, the filter 7 is adapted to dampen frequencies under 1000 Hz. and is suitably constructed to dampen lower frequencies within this range to a greater extent than the higher frequencies. Thus, the filter 7 will filter out light incident on the receiver but not transmitted by the transmitter 4*a*. It has been found that such a filter greatly reduces the risk of erroneous indications resulting from interference from surrounding lamps and the like.

The filter 7 is connected to an amplifier 8, the amplifying effect of which can be controlled in a known manner by means of a resistance R1. The amplifier 8 is energized from a source of d.c. current 6 through a line 8*a*, and the output of the amplifier is connected to one input of an inverted comparator indicator 10, via a line 10*a*. A constant voltage is applied to the other input of the comparator indicator 9, via a line 9*b*. Similarly, a constant voltage is applied to the inverted comparator indicator 10 via a line 10*b*. The voltage to the other input of the comparator indicator 9 can be regulated through a resistance R2. Similarly, the constant voltage on the inverted comparator indicator 10 can be regulated by means of a resistance R3, although in this instance, regulation of said voltage must be performed before the arrangement is in operation, since the voltage on the second input 10*b* of the inverted comparator indicator 10 constitutes a limit level for the leading edge 2*a* of the sheet material 2, and to exceed this limit would result automatically in creating an indication signal. In contrast, the voltage in the second input of the comparator indicator 9 can be regulated while the printing machine is in operation to enable the detecting range of the arrangement to be controlled and regulated.

A voltage is applied to the resistance R2 via a line 11 and to the resistance R3 via a line 12. Operating voltage is supplied to the comparator indicator 10 over a line 13. The output 9c of the comparator indicator 9 is connected to a relay 14, and the output 10*c* of the inverted comparator indicator 10 is connected to a relay 15, the two relays 14, 15 obtaining a feed voltage over a line 16. The relay 14 is arranged to actuate a switch 17, while the relay 15 is arranged to actuate a switch 18. Thus, energization of either the relay 14 or the relay 15 will cause activation of the relevant switch 17 or 18, and when a switch 19 forming part of the arrangement according to the invention occupies the position shown in FIG. 2, an alarm is signalled through line 20, and when the switch 19 occupies the other position, a stop indication is signalled through a line 21. Similarly, a switch 22 is provided to control the signal indication on switch 18, to indicate an alarm via line 23, or to send a stop signal via line 24.

Figure 3:
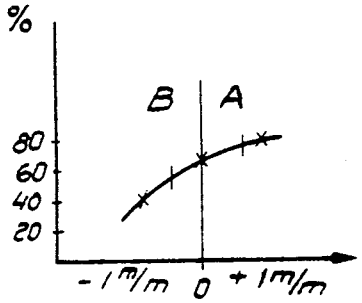
FIG. 3 illustrates diagrammatically the output voltage of the amplifier connected to the beam receiver.

FIG. 3 illustrates the voltage occuring on line 9*a*, 10a, plotted on the abscissa axis, in response to projection of the leading edge of the sheet material into the operative field of the beam transmitter, plotted on the ordinate axis. It should be understood that the inverted comparator indicator 10 is supplied with a bias voltage in line 10*b*, so that an indication signal is produced as soon as the material passes the point A in FIG. 3. The voltage in the line 9b is so adjusted that the comparator indicator 9 produces a signal when the leading edge 2*a* of the sheet material arrives at point B in FIG. 3.

Assuming that the leading edge 2*a* of the sheet material passes too far through the light beam from the beam transmitter, a relatively high voltage will appear in the line 9*a*. The comparator indicator 9 is so designed that when the voltage in one input 9*a* is equal to or exceeds the voltage in the other input 9*b*, no voltage or a "O" will appear in the output line 9*c*. Furthermore, the inverted comparator indicator 10 is so designed that when the voltage on one input 10*a* exceeds the voltage for the other input, a voltage of predetermined magnitude appears in the output line 10*c* of the inverted comparator indicator 10. On the other hand, if the voltage level in one imput 10*a* is less than or equal to the voltage level in the other input 10*b*, no voltage will appear in the output line 10*a*. Hereinafter a zero voltage is designated "0," while a voltage in the output lines 9*c* or 10*c* is designated "1."

Thus, should the leading edge 2*a* of the sheet material move too far forward, a higher voltage will occur on the line 9*a*, which causes a "0" voltage to appear on line 9*c*. On the other hand, the relay 15 is energized and the switch 18 activated, whereupon the switch 22 will cause an alram signal to be sent via line 23.

Should the leading edge 2*a* of the material only pass slightly into the beam from the transmitter 6*a*, the voltage level on line 9*a* will be considerably lower than the voltage level in line 9*b*, which means that a voltage will appear in output line 9*c* and energize the relay 14, which activates the switch 18. The switch 19 will then cause an alarm device to be activated via line 20.

If, on the other hand, the said leading edge is located exactly in the desired position, in the beam from transmitter 6*a*, the relays 14, 15 remain de-energized, since the bias voltages in lines 9*b* and 10*b* are selected for this purpose.

It should be clearly understood from the foregoing that the resistances R2 and R3 serve as control means for determining the sensitivity of the arrangement according to the invention. The curve shown in FIG. 3 can be raised or lowered in the diagram in response to the setting of resistance R1, i.e., in response to regulation of the amplification.

The amplifier 8 is preferably a selective linear amplifier with circuits tuned to a frequency of 5 kHz, whereby the frequencies produced by the modulator 5 can be selectively detected.

The present invention also relates to an arrangement in silkscreen printing machines for producing a signal when a sheet material to be printed and held by the gripping elements assumes a position which deviates from a predetermined position. The machine illustrated in FIG. 4 has a reciprocating or translatory movable drum 1*b* arranged to cooperate with a stencil (not shown). The stencil is pressed against the sheet material during a printing sequence by means of a squeegee. The position of the sheet material in the gripping elements is indicated by means of at least two beam transmitters placed in the immediate vicinity of an equal number of beam receivers. At least one transmitter and one receiver is located adjacent the desired position of the leading edge of the sheet material. The respective beam transmitters are connected to an indicating device which is activated when the sheet material assumes a deviated position. It is a basic requisite of the present invention that the beam transmitter and the beam receiver are fixedly mounted on the drum 1b adjacent the gripping elements which are also mounted on the drum. This transmitter and receiver set detects and indicates the position of the sheet material in the gripping elements 3.

The structural arrangement of the beam transmitter and the beam receiver and the special circuitry for detecting and indicating a deviated position of the sheet material are described above.

Figure 4:
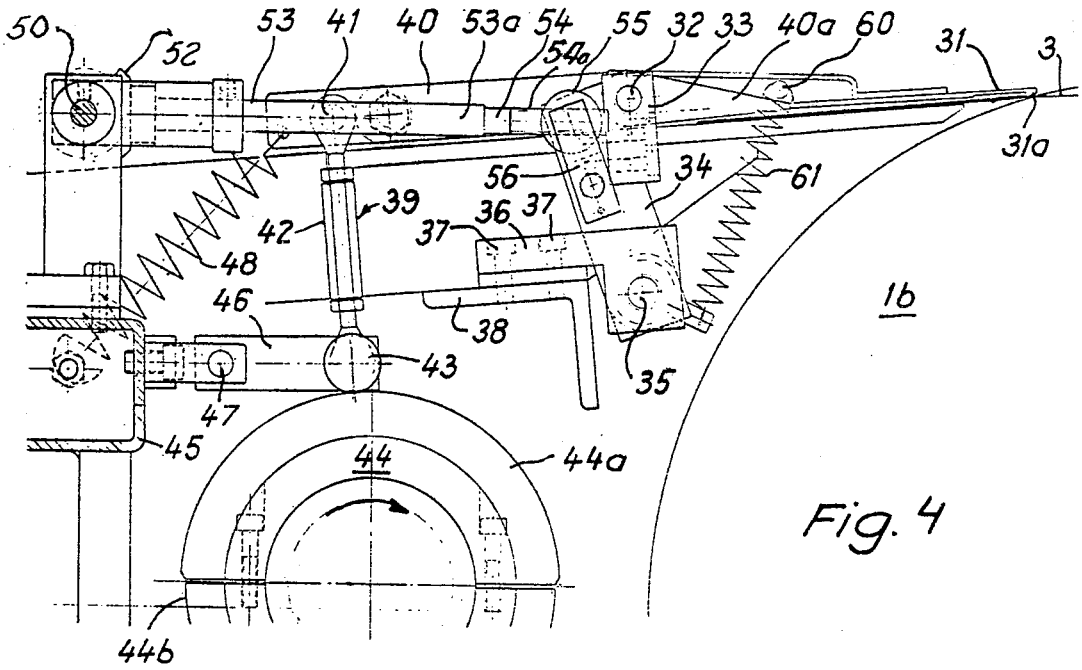
FIG. 4 is a side view of the means for moving the stop arranged to engage the leading edge of the sheet material.
Figure 5:
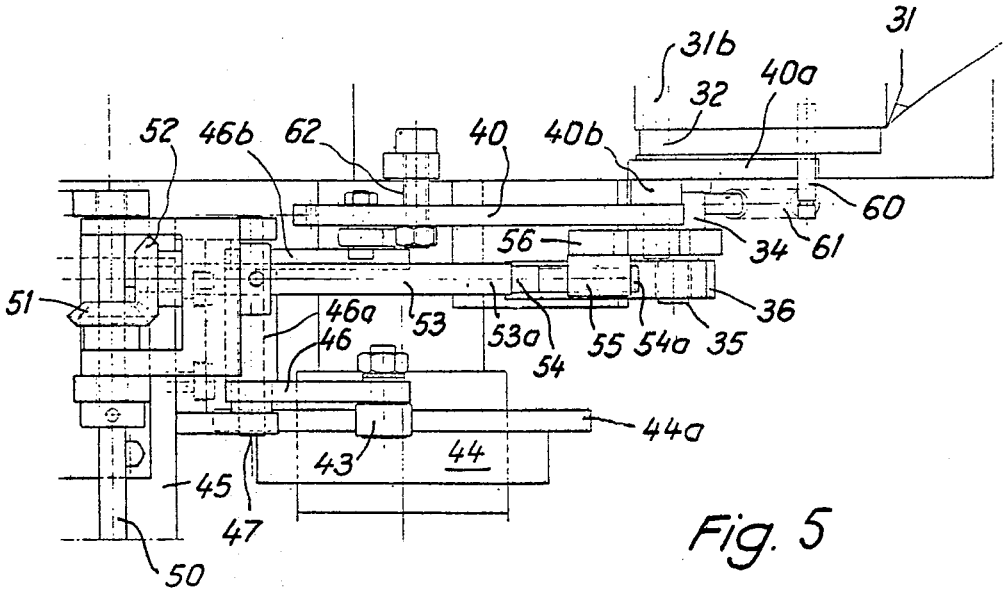
FIG. 5 is a plan view of the arrangement shown in FIG. 4.

FIG. 4 shows in side elevation an embodiment in which the leading edge of the sheet material to be printed engages a stop 31, so that the leading edge assumes an exact position relative to the gripping elements 3. The stop 31 of the illustrated embodiment comprises a plate which extends across the entire machine and comprises a number of projections. On one end of the stop plate 31*b* (see in FIG. 5) a hook 31*a* is provided, while the other end of said plate is pivotally mounted on a pin 32 which cooperates with a support 33. The support 33 is firmly connected to a support portion 36 via a shaft 35, said support portion being firmly mounted to a frame portion 38 in the silkscreen printing machine by screws 37. The hook 31*a* is adapted to assume a position in which it cooperates with the sheet material 2, shown in FIG. 4, and a sheet material release position, by means of a lever 40 which is pivotally mounted on the pin 32 and which has a portion 40*a*, the free end of which cooperates with a pin 60 securely mounted on the stop 31. The portion 40*a* is attached to the lever 40 through spacing means 40*b*. The pin 60 is biased into abutment with the portion 40*a* by a spring 61 and is located on one side of the pin 32. Arranged on the other side of the pin 32 is a means 39 for actuating the stop 31, via lever 40, 40*a*, so as to move the same in the described manner. The hook 31*a* is moved away from the peripheral surface of the drum 1*b* by the lever 40 and a shaft 41, to which is journalled rod 42, the end 43 of which rides on a cam plate 44. When the end 43 of rod 42 engages the peripheral surface position 44*a*, of the cam 44, the hook 31*a* assumes a position in which it engages the leading edge of the sheet material, but when the cam plate 44 is rotated to a position in which a peripheral surface portion 44*b* thereof engages said end 43, the lever 40 will rotate counter-clockwise about the pin 32, and the hook 31*a*, via the pin 60, will assume a position remote from the drum 1*b*, whereupon the sheet will be moved to the printing position by the gripping elements 3. The end 43 of rod 42 is also pivotally connected to a portion 45 of the frame by the arm 46, which is journalled to the pin 47. A spring 48 is biased to urge the lever 40 to a position in which the hook 31 is out of engagement with the leading edge of the sheet material.

According to the invention, the hook 31a is adjustable and movable relative to the drum 1*b* by means of a pin 50, which is mounted to rotate in clockwise and counter-clockwise directions, the hook being moved towards the gripping elements by one of the directional movements of said pin and away from said elements by the other one. The pin 50 carries a gear 51, which engages a further gear 52 carried by a shaft 53, the end 53*a* of which has a narrowed portion 54 which is provided with a threaded portion 54*a*. The threaded portion 54*a* engages a bushing 55 fixed to a support portion 56, which, in turn is fixed to the holder 34. By turning the shaft 53, the holder 34 is displaced either toward or away from the drum 1*b* together with the hook 31*a*, depending on the direction in which the shaft is turned. In this manner, the leading edge of the sheet material can be accurately adjusted with respect to the location of the gripping elements 3, which varies in response to changes in the printing speed of the drum 1*b*, as hereinbefore explained.

Although the invention has been described with reference to the illustrated embodiment, it is not restricted thereto, but can be modified within the scope of the following claims.

It should be mentioned that the modulator 5, which supplies current to the beam transmitter, is tuned to reject as far as possible undesirable signal frequencies encountered from nearby light sources.

Further, the portion 44*b* of the illustrated cam plate 44 can be smaller and the lever 40 can be arranged to drop against a stop, such as that shown at 62.

By means of the above described arrangement comprising a detector circuit for detecting the position of the sheet material relative the drum and the gripping elements, it is possible to adjust the position of stop 31 in response to changes in printing speed of the machine. For the purpose of changing the position of the end 43 of the rod 42, to actuate the lever 40, the arm 46 has a shaft 46*a* which is pivoted to the shaft 47, whcih shaft has an arm 46*b* extending therefrom, the free end of said arm being connected to the rod 42, the length of which can thus be adjusted by conventional screw thread means.

Further, although the sheet material position detecting and signalling means have been described as optical devices, acoustic or other appropriate devices may be used.

What is claimed is:

1. In a stencil printing machine having a translatory movable printing drum means for carrying a length of sheet material to be printed, a stencil cooperatively associated with the drum, squeegee means for urging the stencil against the sheet material to be printed during a printing sequence, feed table means for feeding the length of sheet material to the drum, gripping element means mounted on the drum for gripping a leading edge of the sheet material and carrying it beneath the squeegee means, and sensing means for sensing when the sheet material deviates from a predetermined position in the printing machine, the improvement in sensing means comprising:

at least one beam transmitter and at least one beam receiver located adjacent thereto, the beam receiver receiving a beam from the transmitter which has been reflected from the sheet material in the field of the beam transmitter, the beam transmitter and receiver being firmly mounted on the drum adjacent the gripping element means in a location sensing the positioning of the sheet material leading edge in the gripping element means during a printing operation, the beam transmitter and receiver producing an indicating signal in response to the sensing of position, circuit means connecting the beam transmitter and receiver for receiving the indicating signal and activating an indicating means in response thereto.

2. The improved stencil printing machine as claimed in claim 1 wherein the circuit means is a comparator circuit for ascertaining the extent of penetration of the sheet leading edge into the beam field and includes comparator indicator means for producing a signal to activate one indicating means in response to a slight penetration of the beam field by the sheet material leading edge, for producing a signal to activate another indicating means in response to a greater penetration of the beam field by the sheet material leading edge and for producing a signal which does not activate either of the indicating means when the sheet material leading edge is located exactly in the desired position for gripping by the gripping element means.

3. The improved stencil printing machine as claimed in claim 2 wherein the comparator circuit includes means for controlling the sensitivity of the comparator indicator means.

4. The improved stencil printing machine as claimed in claim 1 further comprising a stop means for engaging the sheet material leading edge in its proper predetermined position relative to the drum gripping element means, the stop mens being controlled to become disengaged from the sheet material upon the gripping engagement between the gripping element means and the leading edge of the sheet material to permit movement thereof by the gripping element means.

5. The improved stencil printing machine as claimed in claim 4 wherein the stop means is adjustably movable relative to the printing drum to enable adjustment thereof in response to detection of deviation of the sheet material from its predetermined position.

* * * * *